US011517496B2

(12) United States Patent
Wilson

(10) Patent No.: US 11,517,496 B2
(45) Date of Patent: Dec. 6, 2022

(54) SELF-MASSAGING TOOL

(71) Applicant: MUSCLE RECON LLC, Santa Barbara, CA (US)

(72) Inventor: Wesley Wilson, Santa Barbara, CA (US)

(73) Assignee: MUSCLE RECON LLC, Santa Barbara, CA (US)

( * ) Notice: Subject to any disclaimer, the term of this patent is extended or adjusted under 35 U.S.C. 154(b) by 174 days.

(21) Appl. No.: 16/936,040

(22) Filed: Jul. 22, 2020

(65) Prior Publication Data

US 2021/0022953 A1 Jan. 28, 2021

Related U.S. Application Data

(60) Provisional application No. 62/877,290, filed on Jul. 22, 2019.

(51) Int. Cl.
*A61H 15/00* (2006.01)

(52) U.S. Cl.
CPC . *A61H 15/0092* (2013.01); *A61H 2201/0157* (2013.01); *A61H 2201/169* (2013.01); *A61H 2201/1635* (2013.01)

(58) Field of Classification Search
CPC ..... A61H 15/00; A61H 15/0085; A61H 15/0092; A61H 2015/0014; A61H 2015/0042; A61H 2201/0157; A61H 2201/1635; A61H 2201/169; A61H 2201/1284; A61H 2205/081; A61H 2205/10; A63B 21/4039; A63B 26/003; B65D 81/104; B65D 81/113; B65D 81/133; B65D 65/44; B65D 2525/285; B65D 2525/209
USPC ..... 206/521, 523, 592, 594
See application file for complete search history.

(56) References Cited

U.S. PATENT DOCUMENTS

| | | | | |
|---|---|---|---|---|
| 10,265,583 | B1 * | 4/2019 | Zaffino | A63B 21/4039 |
| 11,071,885 | B2 * | 7/2021 | Hadley | A61H 15/0092 |
| 2012/0035029 | A1 * | 2/2012 | Dye | A63B 21/4033 482/132 |
| 2012/0203151 | A1 * | 8/2012 | Kleiman | A61H 15/00 601/112 |
| 2014/0336022 | A1 * | 11/2014 | Jones | A61H 15/0092 264/238 |
| 2016/0008692 | A1 * | 1/2016 | Townsend | A63B 71/0036 206/315.1 |
| 2016/0059063 | A1 * | 3/2016 | Breibart | A63B 21/4007 482/123 |
| 2017/0156479 | A1 * | 6/2017 | Kwong | A45F 4/02 |
| 2017/0259424 | A1 * | 9/2017 | Vetter | H02J 7/0044 |
| 2018/0326254 | A1 * | 11/2018 | Earls | A63B 71/0036 |
| 2020/0214928 | A1 * | 7/2020 | Morris | A61H 1/00 |
| 2020/0375841 | A1 * | 12/2020 | Owusu | A61H 15/02 |

* cited by examiner

*Primary Examiner* — Colin W Stuart
*Assistant Examiner* — Douglas Y Sul
(74) *Attorney, Agent, or Firm* — Marshall, Gerstein & Borun LLP

(57) ABSTRACT

A massaging tool includes a housing that includes a first shell member and a second shell member. The first shell member defines a first interior cavity, and the second shell member defines a second interior cavity. The housing is configurable in a first orientation where the first shell member is secured to the second shell member and a second orientation where the first shell member is decoupled from the second shell member.

15 Claims, 12 Drawing Sheets

SELF-MASSAGING TOOL

CROSS-REFERENCE TO RELATED APPLICATION

Priority is claimed to U.S. Provisional Patent Application No. 62/877,290, filed Jul. 22, 2019, the entire contents of which are expressly incorporated herein by reference.

FIELD OF THE DISCLOSURE

The present disclosure generally relates to self-massaging tools and, more particularly, to self-massaging tools having multiple operational modes.

BACKGROUND

Tools may be used to assist users in improving their physical health and wellbeing. Massage rollers can provide joint and muscle relief from tension, improve flexibility, and aid in preventing injuries, among other benefits. Massage rollers may come in varying sizes, but are generally cylindrical in form to allow for the device to be rolled across a user's body.

SUMMARY

Embodiments within the scope of the present disclosure are directed to a massaging tool including a housing that includes a first shell member and a second shell member. The first shell member defines a first interior cavity, and the second shell member defines a second interior cavity. The housing is configurable in a first orientation where the first shell member is secured to the second shell member and a second orientation where the first shell member is decoupled from the second shell member.

In some examples, when the housing is configured in the first operational mode, the housing forms a generally cylindrical roller massaging tool. When the housing is configured in the second operational mode, at least one of the first or the second shell members forms a semi-cylindrical half-dome roller. The first shell member may be securable to the second shell member via a number of couplings such as, for example, a magnetic coupling, a draw latch coupling, or a hook and loop fastener. Other examples are possible.

In some examples, the housing is constructed from a crosslinking expanding polymer, and may additionally include a handle operably coupled thereto. In these examples, the handle may be disposed at an end of the housing, which can define a recess between the handle and the end of the housing.

In some approaches, the massaging tool may include at least one support member coupled with at least one of the first or the second housings. The at least one support member may extend outwardly from at least one of the first shell member or the second shell member, and may include a generally planar contact surface. The at least one support member may additionally include a gripping feature coupled with the generally planar contact surface.

In some forms, the massaging tool may further include at least one accessory tool. The accessory tool is removably disposed within at least one of the first interior cavity or the second interior cavity of the housing. In some examples, the at least one accessory tool is in the form of a massage stick, a massage ball, a stretch strap or a fitness tool. At least one of the first interior cavity or the second interior cavity can include an interior storage system dimensioned to store the at least one accessory tool.

In some examples, the housing may include at least one gripping feature disposed on an exterior surface thereof. Further, the massaging tool may include at least one shell casing constructed from a rigid material. The at least one shell casing may be formed in a hexagonal pattern.

BRIEF DESCRIPTION OF THE DRAWINGS

The above needs are at least partially met through provision of the self-massaging tool described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated and/or simplified relative to other elements to help to improve understanding of various embodiments of the present disclosure. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a self-massing roller is provided that is separable into at least two discrete sections. The two sections are securable to form a full cylinder roller. The tool may have varying lengths depending on a desired configuration. For example, the tool may have a diameter of approximately 6", and a length of approximately 24". In other examples, the length of the tool may be between approximately 10" and approximately 36", with diameters ranging from approximately 4" to approximately 8". An interior compartment of the tool may accommodate one or more accessory tools to assist in massaging functions.

Figure 1:
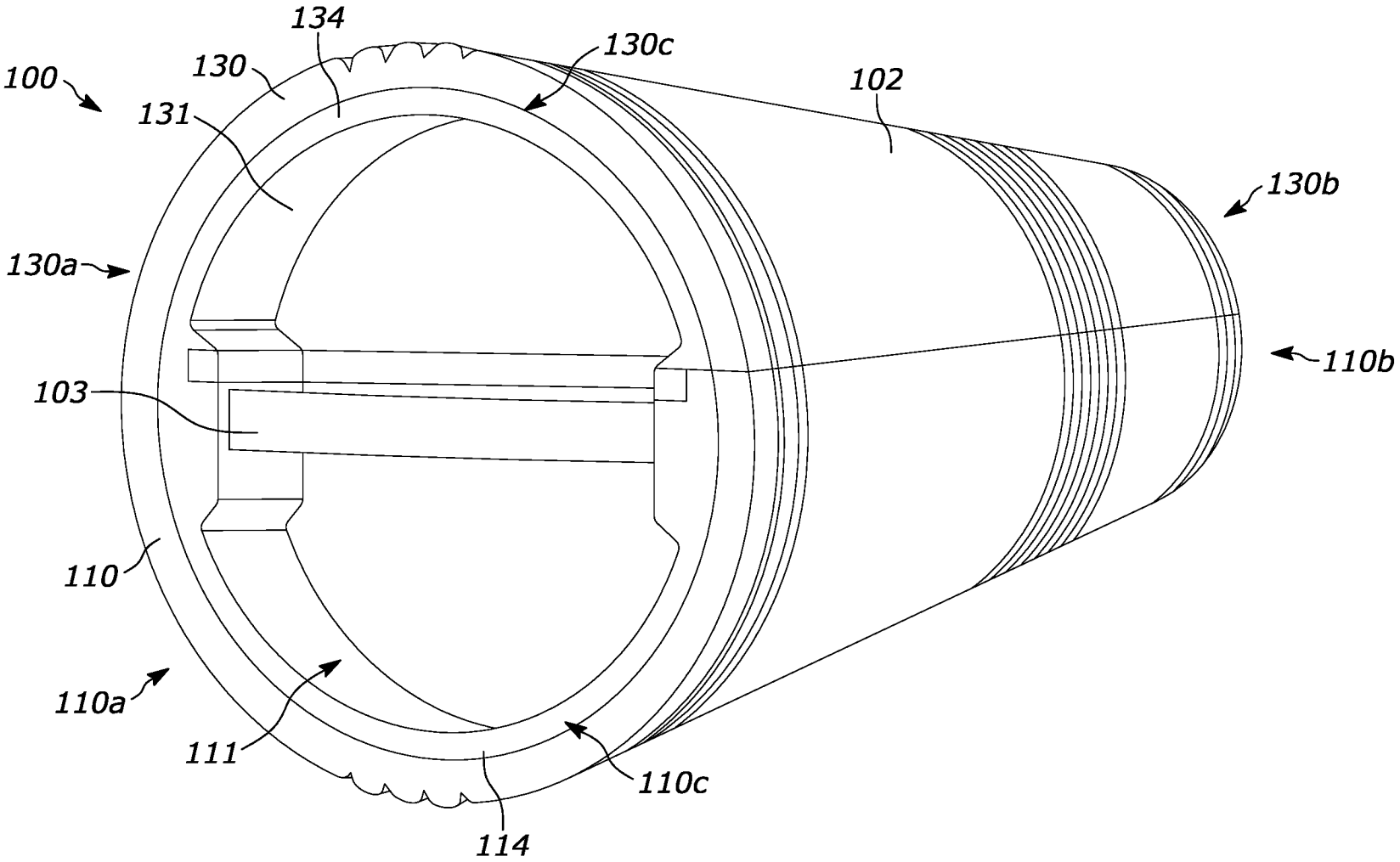
FIG. 1 illustrates a perspective view of an example self-massaging tool in accordance with various embodiments.
Figure 2:
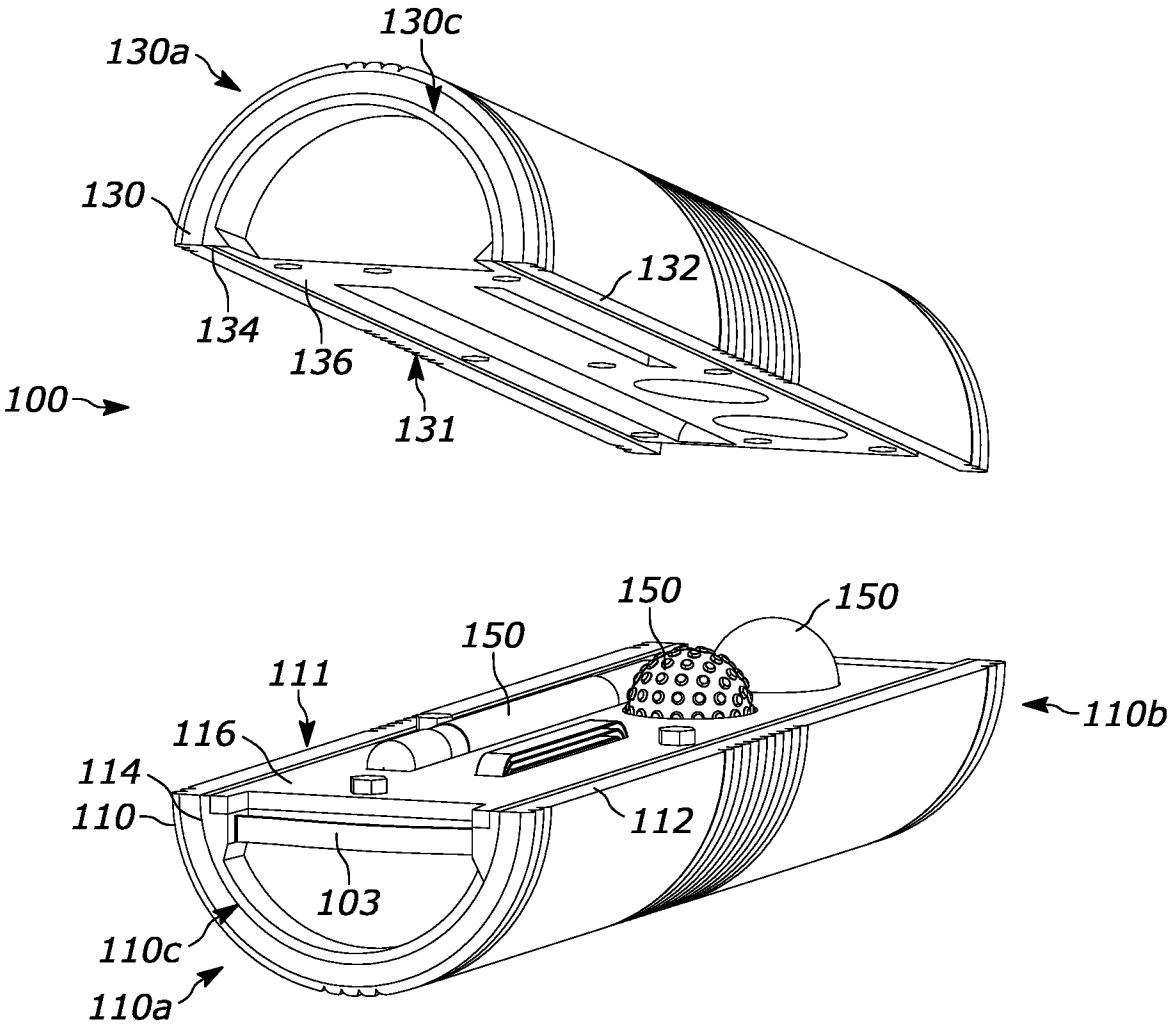
FIG. 2 illustrates a perspective view of the example self-massing tool of FIG. 1 in a decoupled operational mode in accordance with various embodiments.
Figure 3:
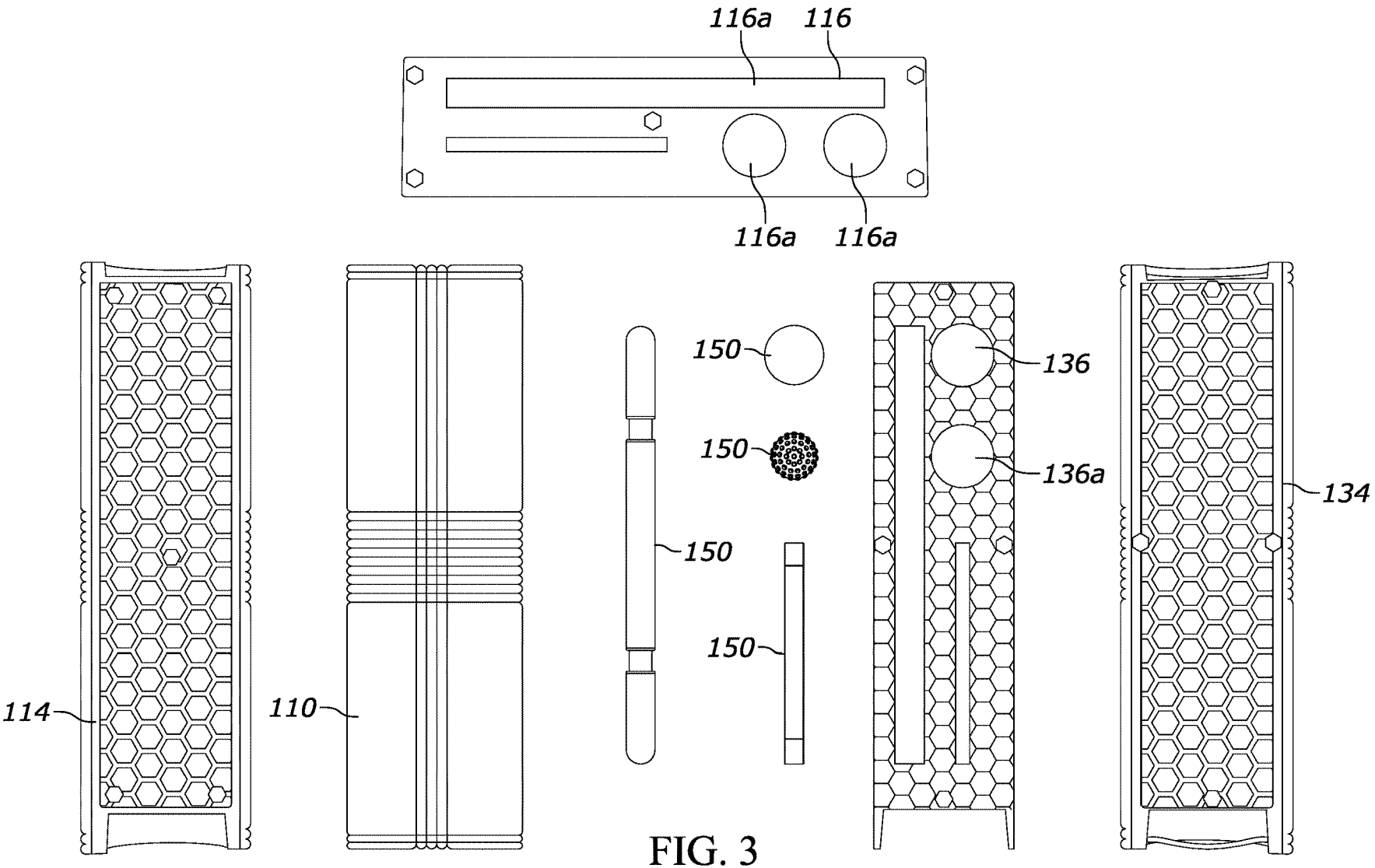
FIG. 3 illustrates a plan view of the example self-massaging tool of FIGS. 1-2 in accordance with various embodiments.
Figure 4:
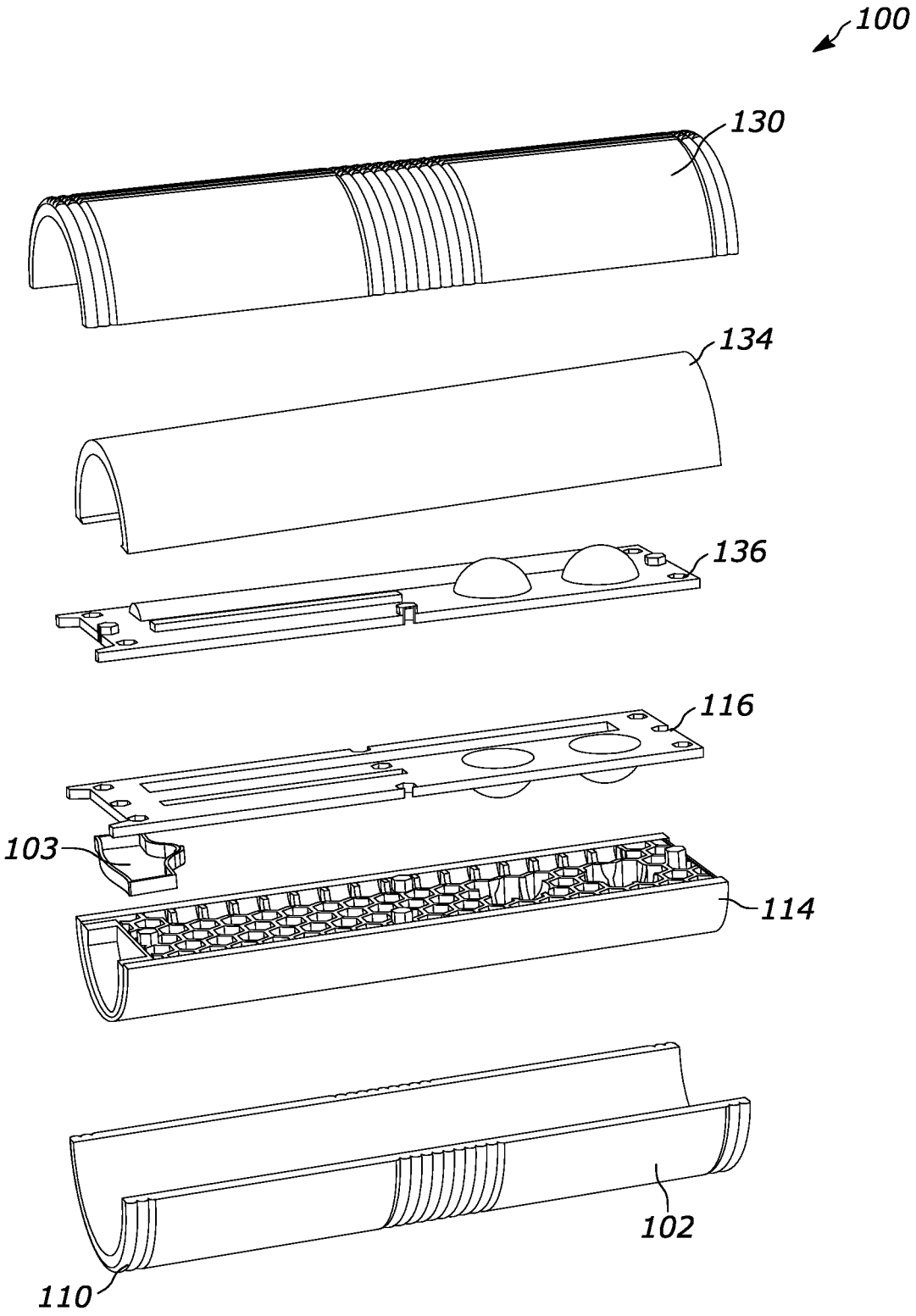
FIG. 4 illustrates an exploded perspective view of the example self-massaging tool of FIGS. 1-3 in accordance with various embodiments.
Figure 5:
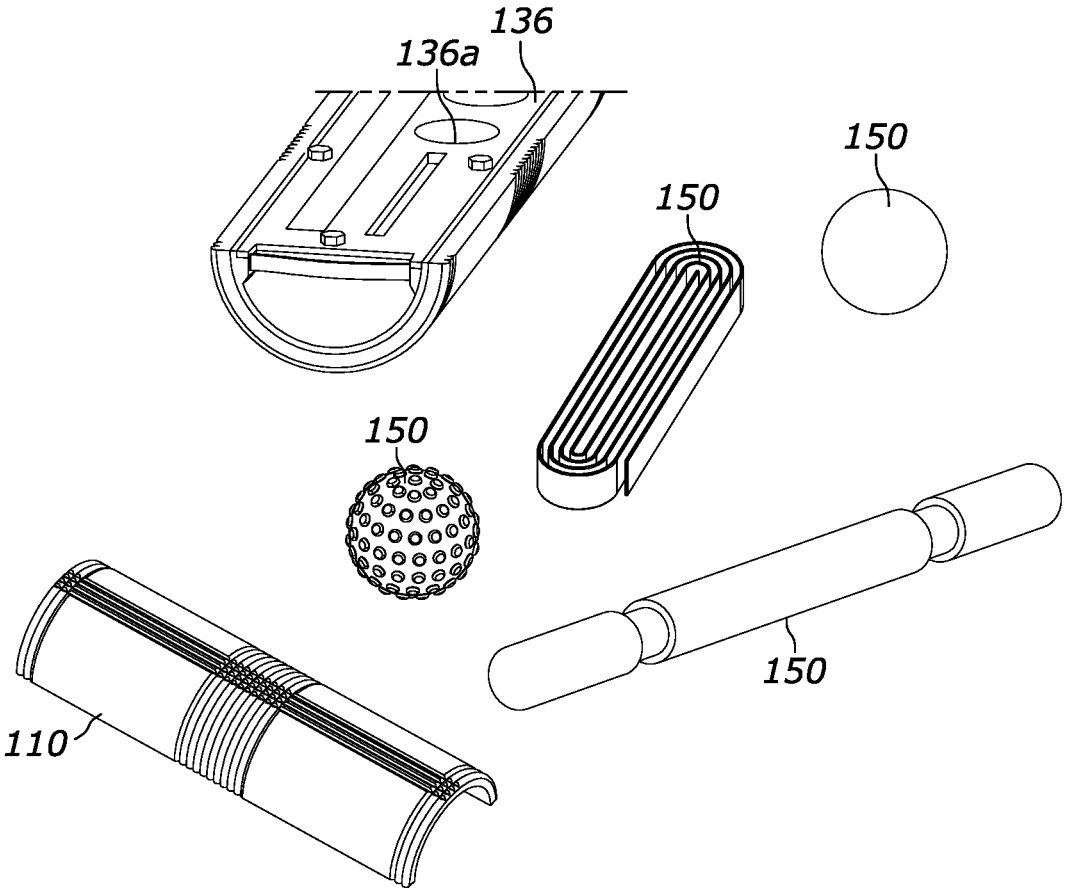
FIG. 5 illustrates a perspective view of the example self-massaging tool of FIGS. 1-4 in a decoupled operational mode in accordance with various embodiments.
Figure 6:
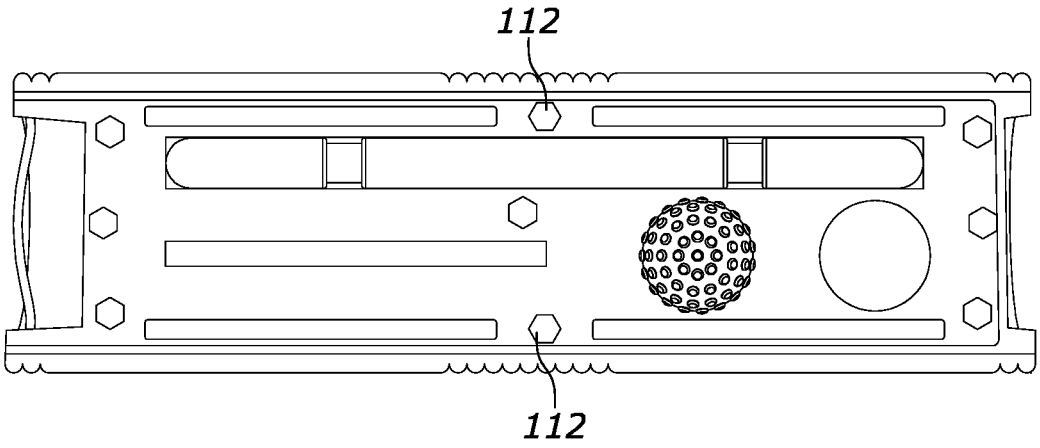
FIG. 6 illustrates a schematic view of the example self-massaging tool of FIGS. 1-5 having a number of accessory tools in accordance with various embodiments.

Turning to the Figures, a self-massaging tool 100 in the form of a foam roller includes a housing 102 including a first shell member 110 and a second shell member 130. The first shell member 110 defines a first interior cavity 111, and the second shell member 130 defines a second interior cavity 131. The housing 102 is configurable in a first operational mode (illustrated in FIG. 1) where the first shell member 110 is secured to the second shell member 120, and is additionally configurable in a second operational mode (illustrated in FIGS. 2, 5, 9, and 10) where the first and second shell members 110, 120 are decoupled from each other. The first shell member 110 includes a first end 110*a*, a second end 110*b*, and an inner surface 110*c* that defines the first interior cavity 111. Similarly, the second shell member 130 includes a first end 130*a*, a second end 130*b*, and an inner surface 130*c* that defines the second interior cavity 131.

The housing 102 may have an outer shell formed from any number of suitable materials such as an expanding cross-linking polymer such as ethylene-vinyl acetate ("EVA") and may have any number of ridges, nodules, bumps, protrusions, and like as desired to assist in providing increased grip for a user during use. Other examples of suitable materials are possible.

The first shell member 110 further includes at least one coupling portion 112, and the second shell member 130 further includes at least one coupling portion 132 that secures to the coupling portion 112 of the first shell member 110. In some examples, the coupling portions 112, 132 may be integrally formed with the first and second shell members 110, 130, respectively, and in other examples, the coupling portions 112, 132 may be attachable to the first and second shell members 110, 130, respectively. In some examples, the coupling portions 112, 132 may be in the form of magnets, draw latches, and/or hook and loop fasteners. The coupling portions 112, 132 may further be in the form of posts that are insertable into a corresponding opening to serve as alignment features to ensure the first and second shell members 110, 130 are properly aligned when in the full cylindrical roller configuration. Other examples are possible.

As previously noted, the tool 100 may be configurable in first and second operational modes. In the first operational mode, the coupling portion or portions 112 of the first shell member 110 are operably coupled with the coupling portion or portions 132 of the second shell member 130, and as a result, the tool 100 forms a full, cylindrical self-massaging foam roller in this operational mode. In the second operational mode, the first shell member 110 and the second shell member 130 are decoupled from each other, and thus either or both of the first and second shell members 110, 130 form semi-cylindrical half dome rollers. In the first operational mode, a user may roll the tool 100 along a length of a desired body part (e.g., a back or a leg), and in the second operational mode, the user may press the tool against the desired body part for a different type of massage function.

As illustrated in FIGS. 4, 7, 12, 13, and 15, each of the first and second shell members 110, 130 may accommodate a shell casing 114, 134, respectively, within respective interior cavities 111, 131. The shell casings 114, 134 may be constructed from a rigid material such as plastic or metal, and can assist in providing structural rigidity to the tool 100. The shell casings 114, 134 may be affixed to the first and second shell members 110, 130 via any number of approaches such as sonic welds, adhesives, fasteners, and the like. In the illustrated examples, the shell casings 114, 134 are in the form of a hexagonal or honeycomb arrangement capable of dispersing forces and loads on the tool when being used, thereby creating a stronger, more stable tool.

Also disposed within the interior cavities 111, 131 are interior storage systems 116, 136 in the form of plate members. The interior storage systems 116, 136 can be operably secured to the shell casings 114, 134 via any number of suitable approaches such as, for example, sonic welds, adhesives, and/or fasteners. The interior storage systems 116, 136 can be constructed from any number of materials such as plastics, foams, rubbers, etc., and can include any number of cutouts 116*a*, 136*a* formed therein to accommodate any number of accessory tools 150.

Figure 13:
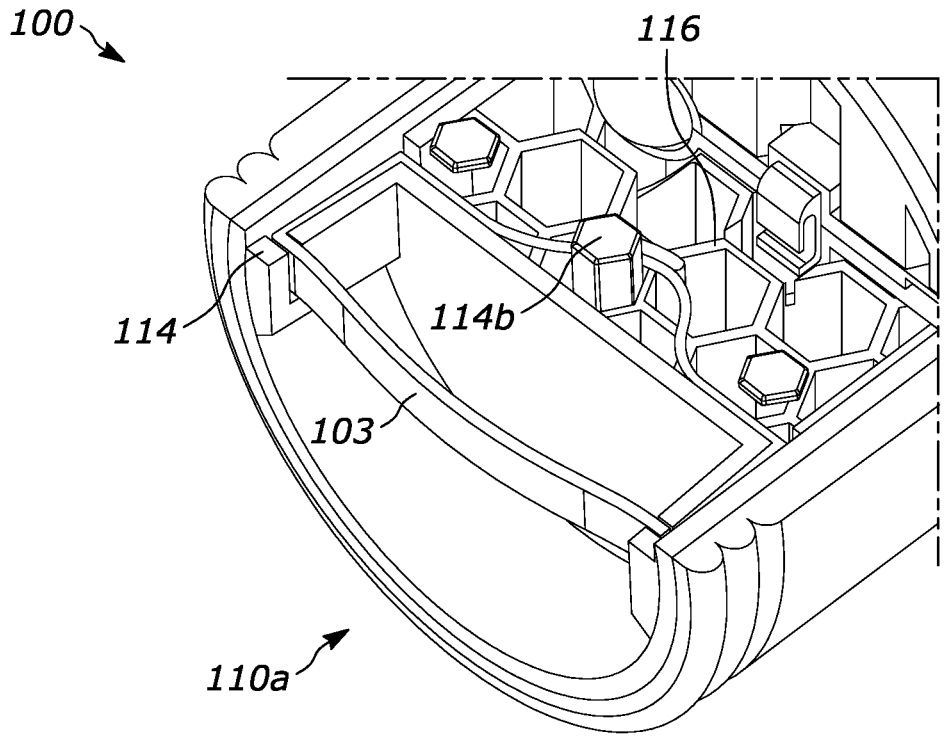
FIG. 13 illustrates a perspective view of an example handle mounting structure of the example self-massaging tool of FIGS. 1-12 in accordance with various embodiments.
Figure 14:
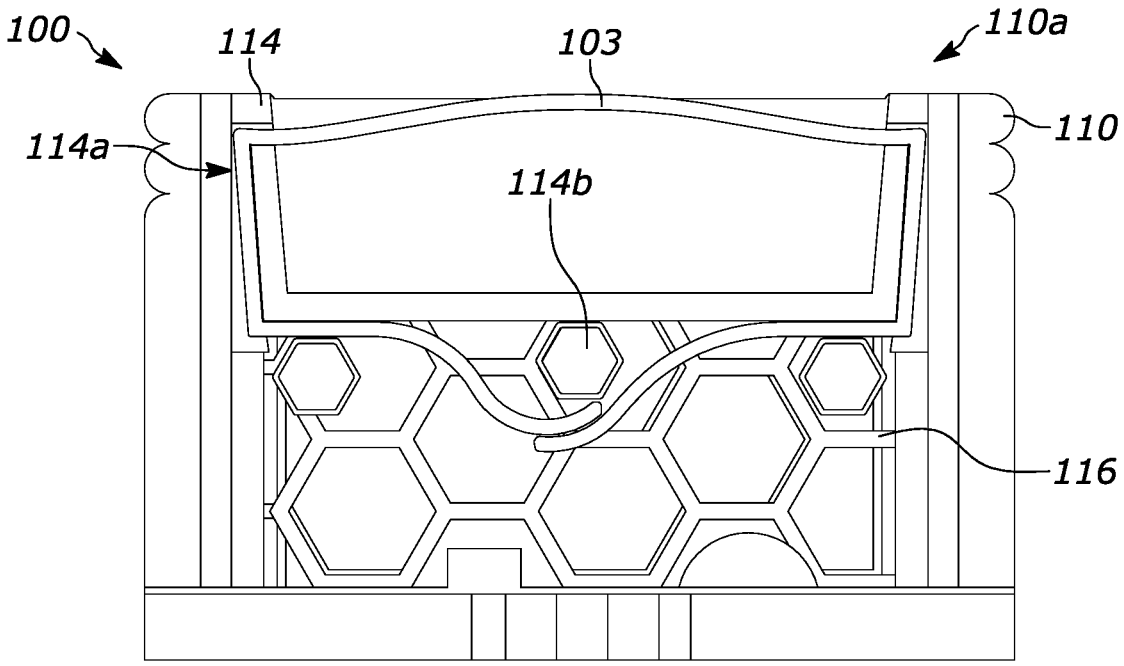
FIG. 14 illustrates a top plan view of the example handle mounting structure in accordance with various embodiments.
Figure 15:
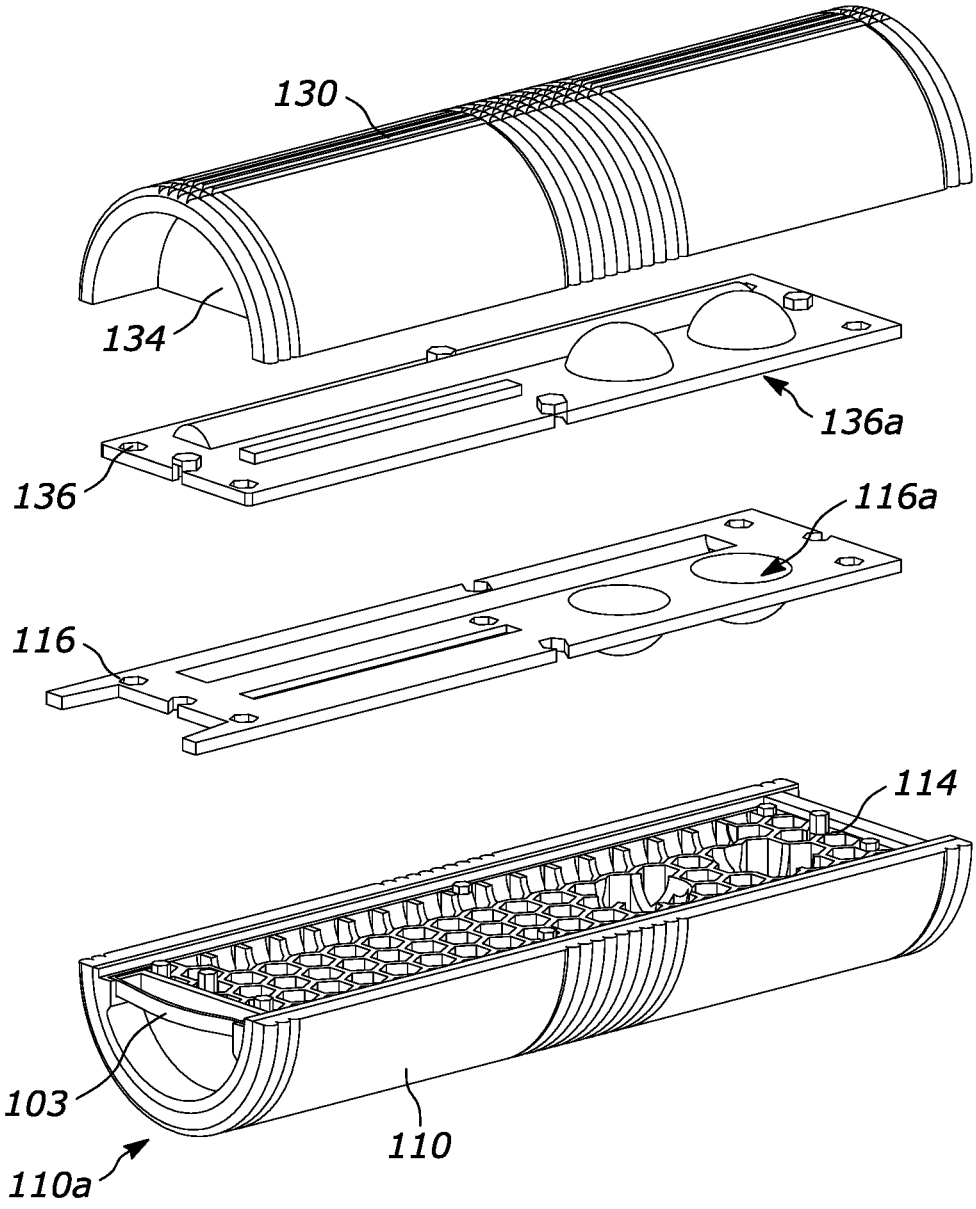
FIG. 15 illustrates a partially-constructed view of the example self-massaging tool of FIGS. 1-14 in accordance with various embodiments.
Figure 16:
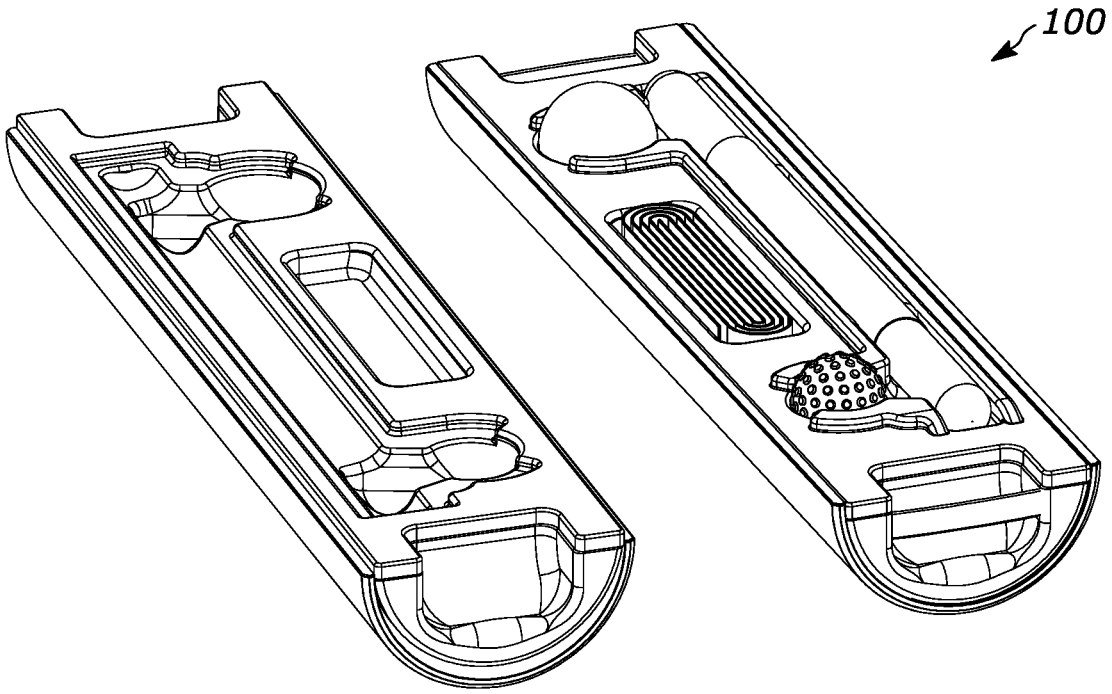
FIG. 16 illustrates a perspective view of the example self-massaging tool of FIGS. 1-15 in the decoupled operational mode in accordance with various embodiments.
Figure 17:
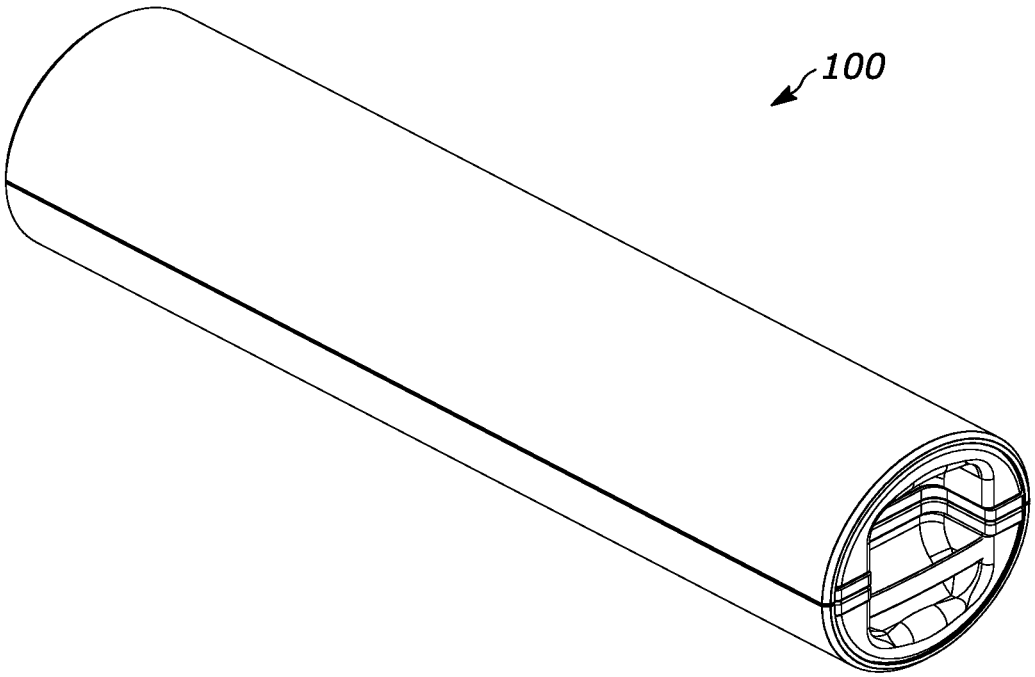
FIG. 17 illustrates a perspective view of the example self-massaging tool of FIGS. 1-15 in the coupled operational mode in accordance with various embodiments.

The tool 100 may additionally include at least one handle 103. The handle 103 may be constructed from a rubber or polymeric material, and can have various dimensions (e.g., a thickness of approximately ½"). In the illustrated example, the handle 103 is positioned at the first end 110*a* of the first shell member 110. In some examples, additional handles may be disposed at and/or coupled with the second ends 110*b*, 120*b* of the first and/or the second shell members 110, 120. The handle 103 may be constructed from any number of suitable materials such as, but not limited to, plastics, metals, and/or woods. As illustrated in FIGS. 13 and 14, the shell casing 114 includes a groove 114*a* used to accommodate, guide, and secure the handle 103 to the tool 100. Further, a mounting post 114*b* may be formed on and/or coupled with the shell casing 114 that a portion of the handle 103 wraps around to provide for additional securing of the handle 103.

The accessory tools 150 may include any number of components to provide varying massage capabilities. For example, the accessory tools 150 may be in the form of a massage stick, a massage ball, a stretch strap, and/or a fitness tool. Other examples are possible.

Figure 7:
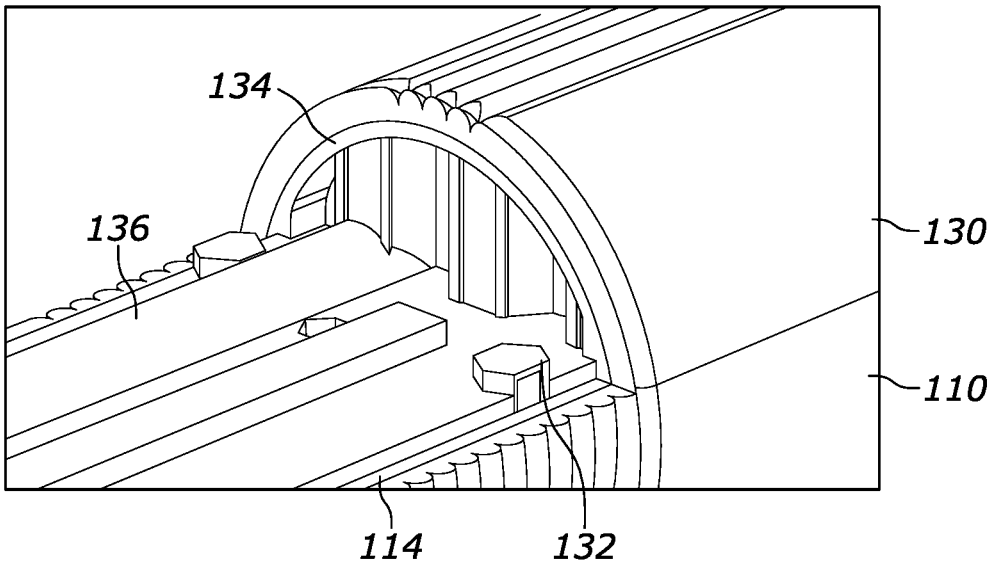
FIG. 7 illustrates a perspective view of an alignment mechanism for the example self-massaging tool of FIGS. 1-6 in accordance with various embodiments.
Figure 8:
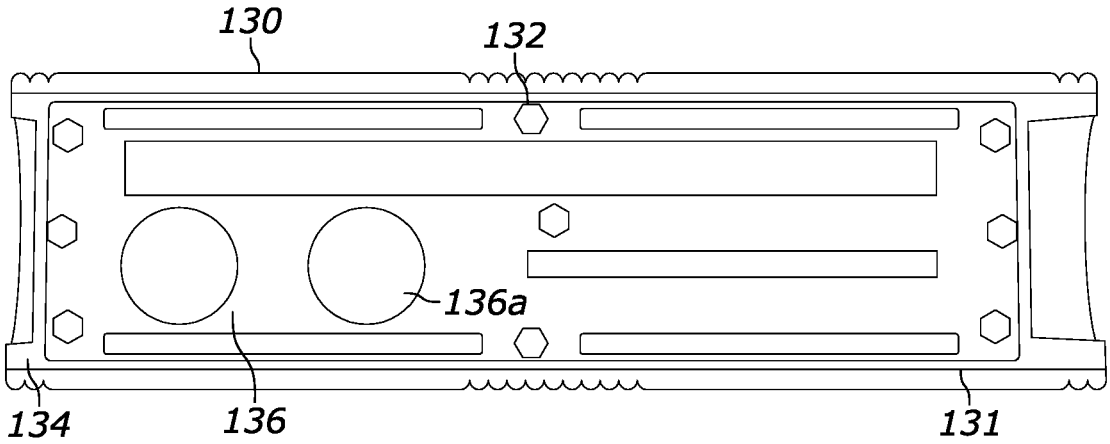
FIG. 8 illustrates a schematic view of an example storage compartment for the example self-massaging tool of FIGS. 1-7 in accordance with various embodiments.
Figure 9:
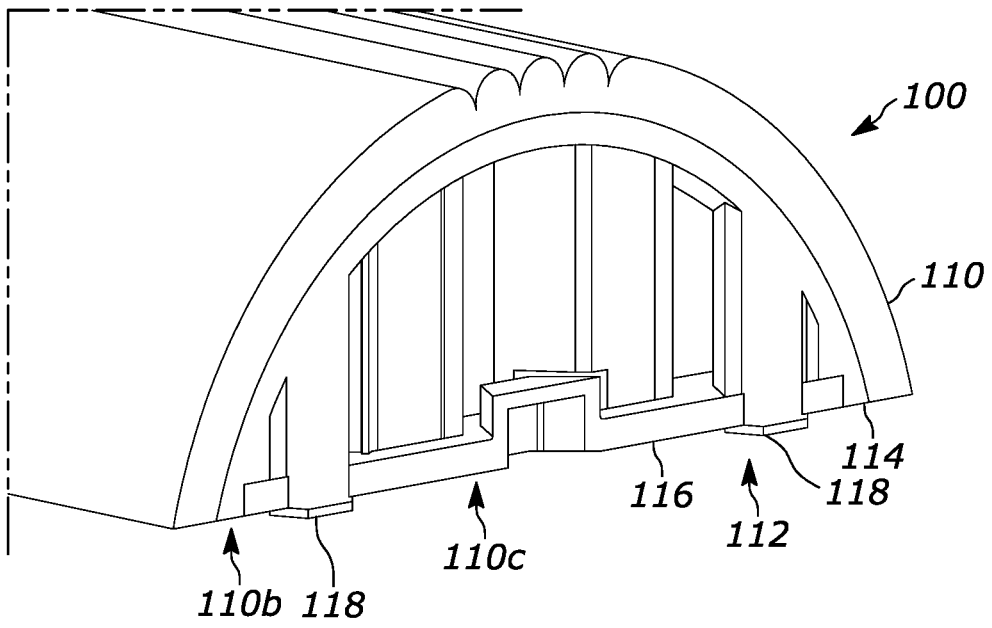
FIG. 9 illustrates a perspective view of the example self-massaging tool of FIGS. 1-8 having a support member in accordance with various embodiments.
Figure 10:
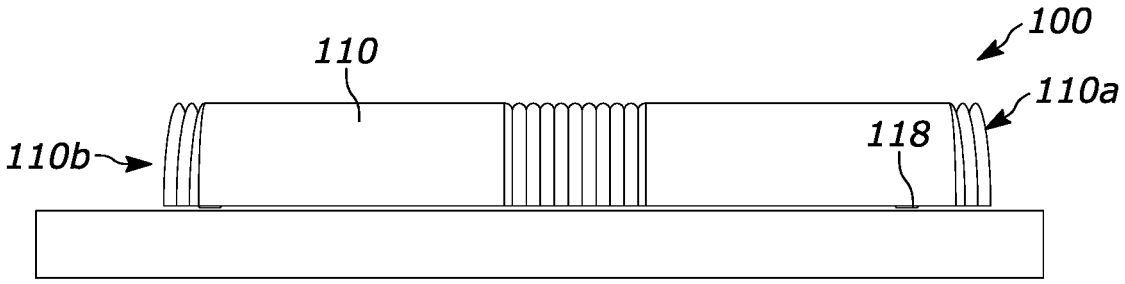
FIG. 10 illustrates an elevation view of the example self-massaging tool of FIGS. 1-9 being positioned on a surface in accordance with various embodiments.
Figure 11:
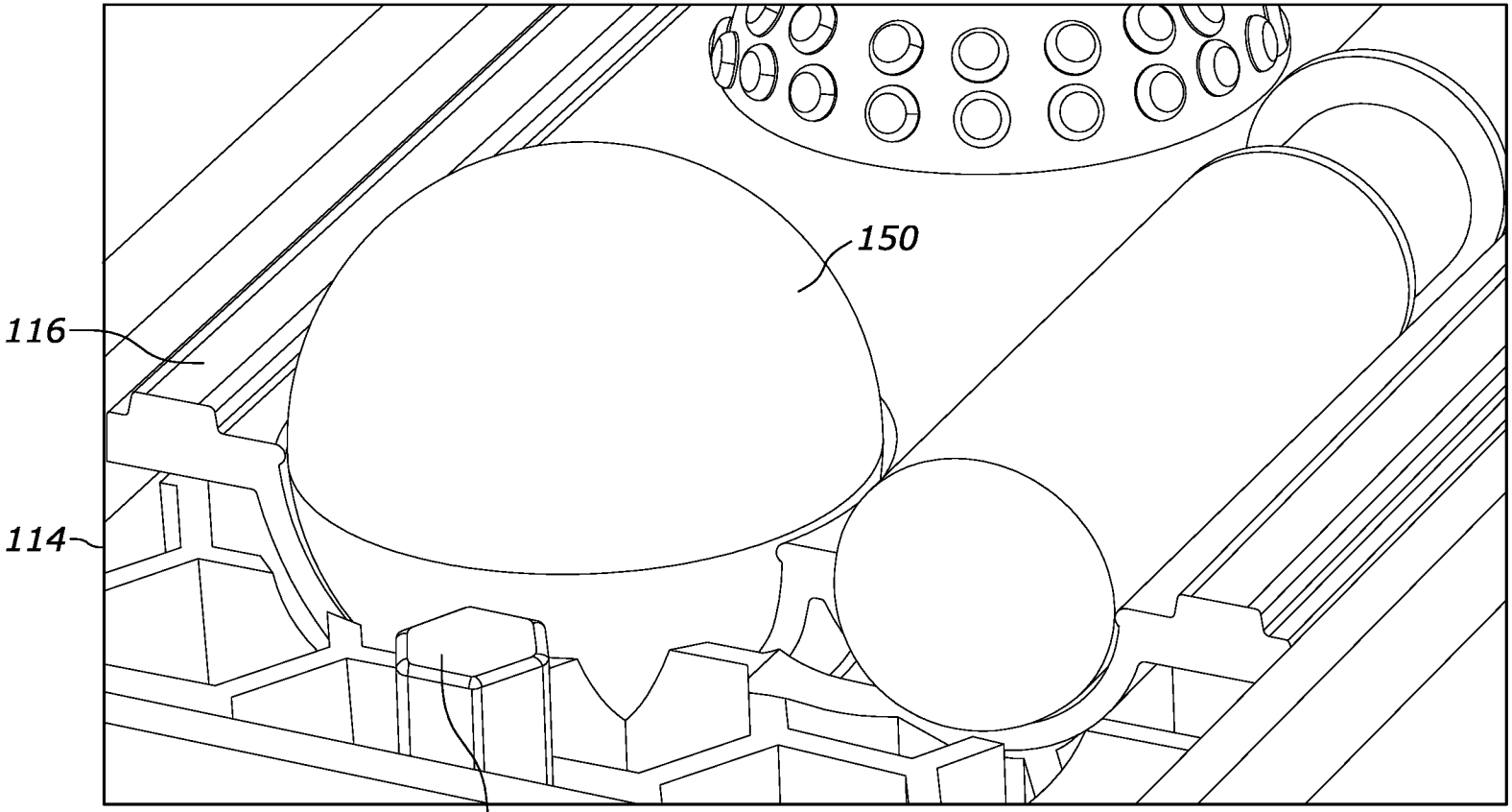
FIG. 11 illustrates a perspective view of an example accessory tool of the example self-massaging tool of FIGS. 1-10 in accordance with various embodiments.
Figure 12:
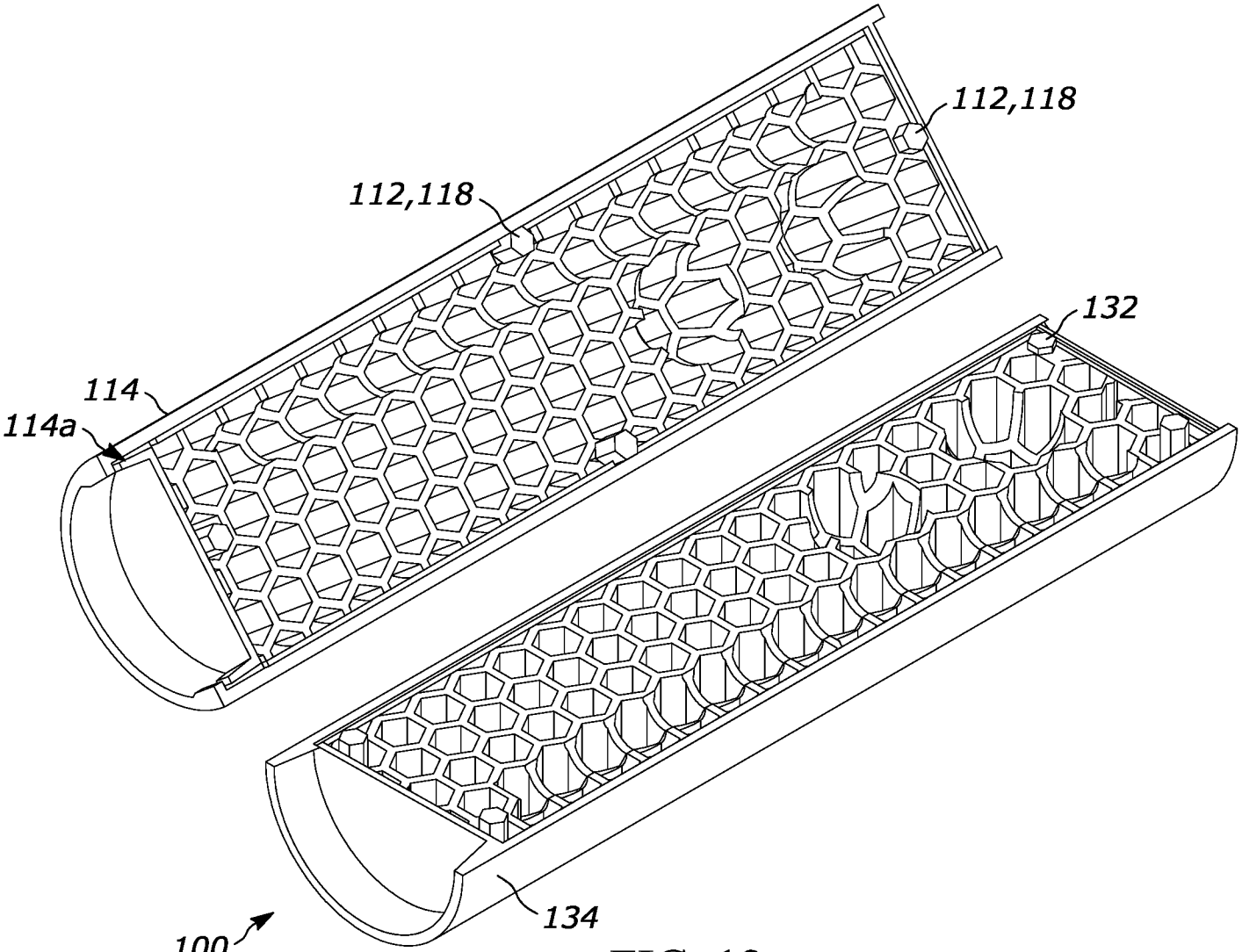
FIG. 12 illustrates a perspective view of an internal load-dispersion structure of the example self-massaging tool of FIGS. 1-11 in accordance with various embodiments.

In some examples, one or both of the first and second shell members 110, 130 may include a support member 118 disposed at varying locations along the shell members 110, 130. As best seen in FIGS. 8-10, the support members 118 extend outwardly from the shell members 110, 130 to provide a level, stable surface for the tool 100 when being used in the half dome roller configuration. The support members 118 include a generally planar contact surface that is placed on the floor or other surface when the tool 100 is in use. In some examples, the planar contact surface may include a gripping feature such as rubber to assist in retaining the tool 100 in a stable position during use. These support members 118 may also assist in load dispersion. As illustrated in FIG. 7, the support members 118 may also serve as the coupling portions 112, 132 to assist with alignment during coupling of the first shell member 110 to the second shell member 130.

So configured, the self-massaging tool effectively provides a deep-tissue self-massage for users. The device can release painful knots while stimulating blood flow to enhance performance and speed up the recovery process. Further, the device, and the accessory tools contained therein, can assist with chronic back pain, stiffness from sitting for extended periods of time, myofascial release, flexibility and range of motion, posture, injury prevention, recovery from workouts, better sleep, and/or muscle reconditioning.

Unless specified otherwise, any of the feature or characteristics of any one of the embodiments of the self-massaging tool disclosed herein may be combined with the features or characteristics of any other embodiments of the self-massaging tool. Those skilled in the art will recognize that a wide variety of modifications, alterations, and combinations can be made with respect to the above described embodiments without departing from the scope of the disclosure, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s). The systems and methods described herein are directed to an improvement to computer functionality, and improve the functioning of conventional computers.

What is claimed is:

1. A massaging tool comprising:

a housing including a first shell member defining a first interior cavity and a second shell member defining a second interior cavity;

a first shell casing adapted to be at least partially disposed within the first interior cavity of the first shell member, the first shell casing constructed from a rigid material and including a honeycomb support arrangement;

a first interior storage system adapted to be operably secured with the first shell casing, the first interior storage system including at least one cutout adapted to accommodate an accessory;

wherein the housing is configurable in a first operational mode where the first shell member is secured with the second shell member and a second operational mode where the first shell member is decoupled from the second shell member, wherein the first shell casing includes a recessed portion dimensioned to receive the at least one cutout of the first interior storage system.

2. The massaging tool of claim 1, wherein when the housing is configured in the first operational mode, the housing forms a cylindrical roller massaging tool.

3. The massaging tool of claim 1, wherein the first shell member is securable with the second shell member via at least one of a magnetic coupling, a draw latch coupling, or a hook and loop fastener.

4. The massaging tool of claim 1, wherein when the housing is configured in the second operational mode, at least one of the first shell member or the second shell member forms a semi-cylindrical half-dome roller.

5. The massaging tool of claim 1, wherein the housing is constructed from a crosslinking expanding polymer.

6. The massaging tool of claim 1, further comprising a handle operably coupled with the housing.

7. The massaging tool of claim 6, wherein the handle is disposed at an end of the housing, wherein the end of the housing further defines a recess between the handle and the end of the housing.

8. The massaging tool of claim 7, wherein the handle includes a groove and a mounting post to accommodate and secure a portion of the handle to couple the handle with the tool.

9. The massaging tool of claim 1, further comprising at least one support member coupled with at least one of the first shell member or the second shell member.

10. The massaging tool of claim 9, wherein the at least one support member extends outwardly from at least one of the first shell member or the second shell member and includes a planar contact surface.

11. The massaging tool of claim 10, wherein the at least one support member further includes a gripping feature coupled with the planar contact surface.

12. The massaging tool of claim 1, further comprising at least one accessory tool being removably disposed within at least one of the first interior cavity or the second interior cavity of the housing.

13. The massaging tool of claim 12, wherein the at least one accessory tool includes at least one of a massage stick, a massage ball, a stretch strap, or a fitness tool.

14. The massaging tool of claim 12, wherein the first interior storage system is dimensioned to store the at least one accessory tool.

15. The massaging tool of claim 1, wherein the housing includes at least one gripping feature disposed on an exterior surface thereof.

* * * * *